US008737648B2

(12) United States Patent
Chen et al.

(10) Patent No.: US 8,737,648 B2
(45) Date of Patent: May 27, 2014

(54) SPATIALIZED AUDIO OVER HEADPHONES

(76) Inventors: Wei-ge Chen, Sammamish, WA (US); Zhengyou Zhang, Bellevue, WA (US)

( * ) Notice: Subject to any disclaimer, the term of this patent is extended or adjusted under 35 U.S.C. 154(b) by 760 days.

(21) Appl. No.: 12/472,080

(22) Filed: May 26, 2009

(65) Prior Publication Data

US 2010/0303266 A1 Dec. 2, 2010

(51) Int. Cl.
*H04R 5/02* (2006.01)

(52) U.S. Cl.
USPC ..... 381/310; 381/17; 381/26

(58) Field of Classification Search
USPC ..... 381/17, 26, 310
See application file for complete search history.

(56) References Cited

U.S. PATENT DOCUMENTS 6,125,115 A 9/2000 Smits
6,813,360 B2 * 11/2004 Gentle ..... 381/23
6,973,184 B1 * 12/2005 Shaffer et al. ..... 379/420.01
7,420,935 B2 9/2008 Virolainen
7,439,873 B2 10/2008 Tillotson
7,720,212 B1 * 5/2010 Jouppi et al. ..... 379/202.01
2004/0076301 A1 * 4/2004 Algazi et al. ..... 381/17
2005/0159833 A1 7/2005 Giaimo et al.
2006/0045294 A1 3/2006 Smyth
2006/0133619 A1 6/2006 Curry et al.
2006/0204016 A1 9/2006 Pham et al.
2007/0025538 A1 2/2007 Jarske et al.

OTHER PUBLICATIONS

Vesterinen, Leena, Audio Conferencing Enhancements, Master's Thesis, University of Tampere, Department of Computer Sciences, Interactive Technology, http://tutkielmat.uta.fi/pdf/gradu01162.pdf (Jun. 2006).

* cited by examiner

*Primary Examiner* — Matthew W Such
*Assistant Examiner* — Jesse Y Miyoshi

(57) ABSTRACT

A spatial element is added to communications, including over telephone conference calls heard through headphones or a stereo speaker setup. Functions are created to modify signals from different callers to create the illusion that the callers are speaking from different parts of the room.

15 Claims, 7 Drawing Sheets

SPATIALIZED AUDIO OVER HEADPHONES

BACKGROUND

This Background is intended to provide the basic context of this patent application and it is not intended to describe a specific problem to be solved.

Conference calls have been possible for many years. Callers from around the world can call in and discuss topics together. However, on a conference call, it is sometimes hard to tell who is talking. In some cases, voices are distinct and can be recognized. Conversation that occur in person have a spatial element such that if a person speaks from the left, the listener will know the sound is coming from the left. On conference calls, no such spatial element is present making it difficult to tell who is talking.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A spatial element is added to communications, including over telephone conference calls heard through headphones or a stereo speaker setup. Functions are created to modify signals from different callers to create the illusion that the callers are speaking from different parts of the room. To create the function, a signal is communicated from a first location and is received in a left channel and a right channel at a listening point. The received signal at the left and right channel is compared to the communicated signal. A function is created to modify the signal to minimize the different between the communicated signal and the signal received in the left channel and the right channel. This function is then used to modify callers signals to add a spatial element to each caller's signal.

SPECIFICATION

Although the following text sets forth a detailed description of numerous different embodiments, it should be understood that the legal scope of the description is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
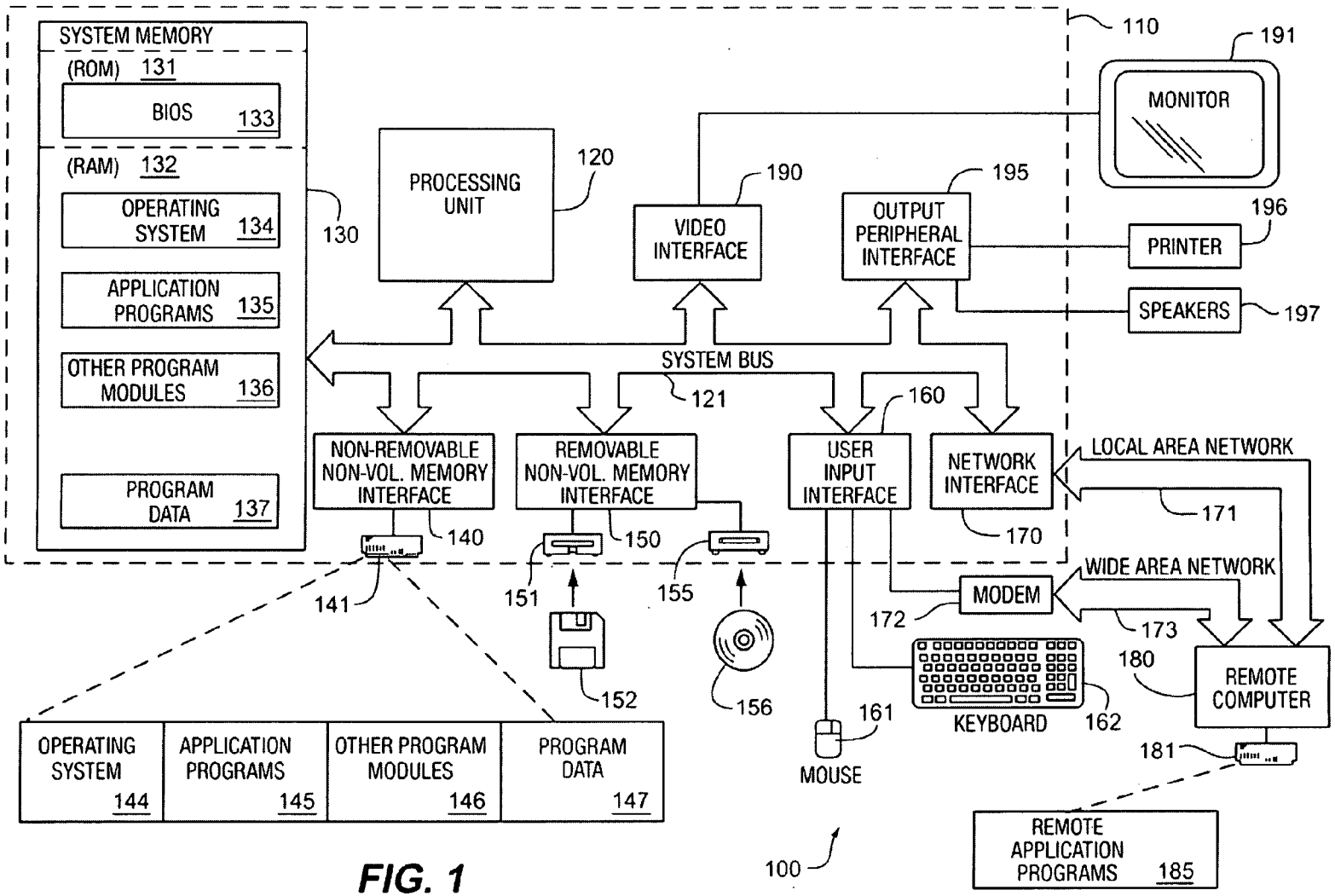
FIG. 1 is an illustration of a computing device.

FIG. 1 illustrates an example of a suitable computing system environment 100 that may operate to execute the many embodiments of a method and system described by this specification. It should be noted that the computing system environment 100 is only one example of a suitable computing environment and is not intended to suggest any limitation as to the scope of use or functionality of the method and apparatus of the claims. Neither should the computing environment 100 be interpreted as having any dependency or requirement relating to any one component or combination of components illustrated in the exemplary operating environment 100.

With reference to FIG. 1, an exemplary system for implementing the blocks of the claimed method and apparatus includes a general purpose computing device in the form of a computer 110. Components of computer 110 may include, but are not limited to, a processing unit 120, a system memory 130, and a system bus 121 that couples various system components including the system memory to the processing unit 120.

The computer 110 may operate in a networked environment using logical connections to one or more remote computers, such as a remote computer 180, via a local area network (LAN) 171 and/or a wide area network (WAN) 173 via a modem 172 or other network interface 170.

Computer 110 typically includes a variety of computer readable media that may be any available media that may be accessed by computer 110 and includes both volatile and nonvolatile media, removable and non-removable media. The system memory 130 includes computer storage media in the form of volatile and/or nonvolatile memory such as read only memory (ROM) 131 and random access memory (RAM) 132. The ROM may include a basic input/output system 133 (BIOS). RAM 132 typically contains data and/or program modules that include operating system 134, application programs 135, other program modules 136, and program data 137. The computer 110 may also include other removable/non-removable, volatile/nonvolatile computer storage media such as a hard disk drive 141 a magnetic disk drive 151 that reads from or writes to a magnetic disk 152, and an optical disk drive 155 that reads from or writes to an optical disk 156. The hard disk drive 141, 151, and 155 may interface with system bus 121 via interfaces 140, 150.

A user may enter commands and information into the computer 20 through input devices such as a keyboard 162 and pointing device 161, commonly referred to as a mouse, trackball or touch pad. Other input devices (not illustrated) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device may also be connected to the system bus 121 via an interface, such as a video interface 190. In addition to the monitor, computers may also include other peripheral output devices such as speakers 197 and printer 196, which may be connected through an output peripheral interface 190.

Figure 2:
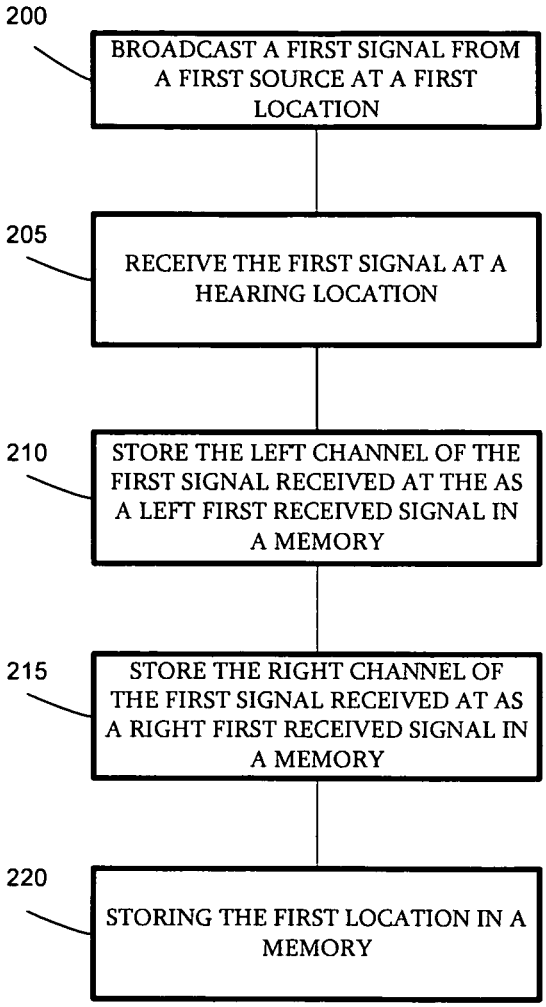
FIG. 2 is method of method of providing directional hearing experience for a conference call.

FIG. 2 is a flowchart of a method of providing directional hearing experience for a conference call. In real life, people can perceive direction with speech. For example, a person talking from the left side will be perceived as talking from the left side. Currently, when different people speak on a conference call, there is no directional component to the speech. In reality, the people in the conference call could be sitting around a table or could be in different parts of the world. It would be useful to have a directional component to conference calls to assist in determine who is speaking.

In most current designs of spatial audio systems aiming at real-time operation, externalization is typically achieved using artificial reverberation. Artificial reverberation is a well-studied topic and as a result, a rich collection of numerically motivated tools have been developed such as feedback delay networks. These tools, although computational efficient, do not have sufficient means to capture most of the subtitles of the environment.

In another extreme, sophisticated modeling techniques, notably wave-equation and ray-tracing based acoustic simulation methods, have emerged as possible candidates for real-time spatial audio synthesis. The cost of implementing these modeling methods on conferencing terminals is not acceptable, not to mention the challenges of building physical models in sufficient detail to be useful.

Instead, the method proposes to bypass any parametric modeling and use the room response directly measured from the actual physical space, i.e. a typical conference room in this case. Furthermore, as early reflections may be so closely coupled to the effect of Head-Related Transfer Function (HRTF), there is little benefit in trying to separately model the room and the head. Suppose a speaking person and a listening person are located in the same room, and assume a linear model from the speaking person's mouth to each of the listening person's two ears. If there are accurate estimates of the two linear responses and the linear responses are used to process the monophonic capture of the voice of the speaking person, a true binaural capture may result.

At block 200, a first signal 305 may be broadcast from a first source 310 at a first location 315. The first signal 305 may be virtually any signal that can be detected by a microphone 320, such as a voice, a tone, music or a speech. In some embodiments, the method is directed to conference call and human voices may be be the logical choice for the first signal 305. Studies on room acoustic measurement suggest a number of good candidates for reference signal r(t). Different choices have been compared and Maximum Length Sequence may be recommended for noisy rooms, and a form of chirp signal (logarithm sine sweep) is recommended for quiet rooms. As the noise level in the measurement environment may be controllable, a chirp signal may be selected due to its other advantages. Thus, $$r(t) = \sin\left(\frac{f_1 T}{\log(f_2/f_1)}\left(e^{t\log(f_2/f_1)/T} - 1\right)\right)$$

where f1 is the starting frequency, f2 is the ending frequency, T is the duration of the reference signal and t represents continuous time. Note that as all of processing steps are finished as digital time samples, the method may subsequently switch to a discrete time notation where r(n) denotes the appropriately sampled version of r(t), etc. Considering only the linear response, the captured signals may be $$s_i^l(n)=r(n)*h_i^l(n)+u(n) \text{ and } s_i^r(n)=r(n)*h_i^r(n)+v(n)$$

for any configuration i (0<i=I), where * denotes linear convolution and u(n) and v(n) are additive noise terms.

Figure 3:
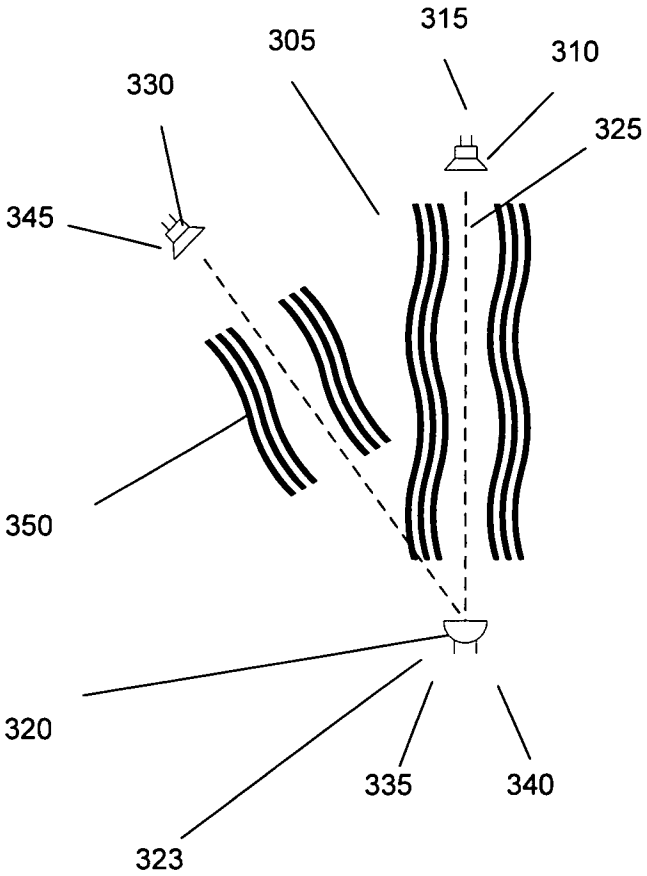
FIG. 3 is an illustration of a first signal being communicated to a hearing location.
Figure 5:
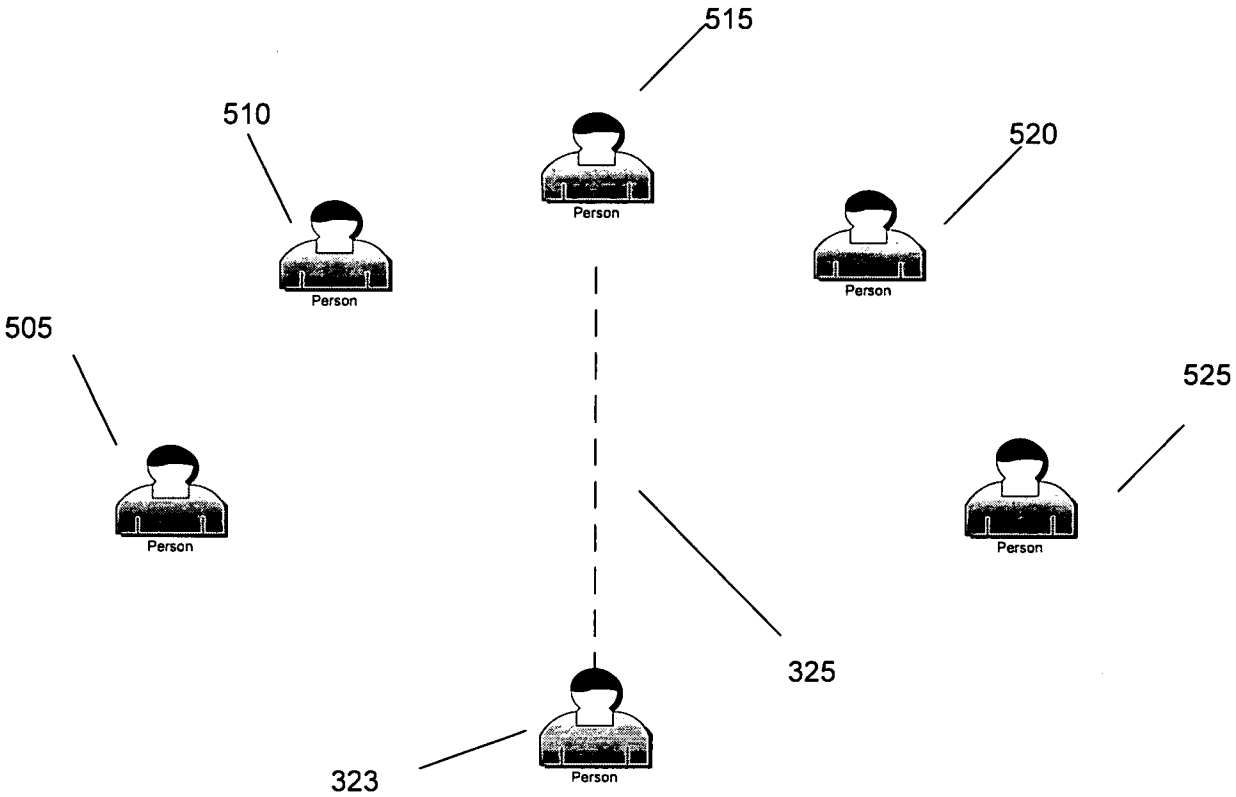
FIG. 5 is an illustration of a group of people on a conference call.

The source 310 may be a speaker as illustrated in FIG. 3 or may be a person (voice) 310 as illustrated in FIG. 5. The first location 315 may be any location that is within a distance such that the first signal 305 may be received by the microphone 320.

The details of the location 315 may be measured and stored in a variety of ways. In one embodiment, the location 315 may have a distance from the microphone 320 and a degree off from a centerline 325 (dashed) from the microphone 320. For example, the first location 315 may be 0 degrees off the center line 325 and the second location 330 may be 30 degrees off the center line 325. In some embodiments, the location may be stored in a 360 degree format, such that the first location 315 may be stored as 0 degree and the second location 330 may be stored as 330 degrees (360−30). In addition, the location may include some data about the environment, such as the size of the room or the distance from the first source 315 to the surrounding walls, etc. Other data may include the surface of the walls, whether there are windows in the location and if so, ambient noise in the room, how many, the type of ceiling, the ceiling height, the floor covering, etc.

At block 205, the first signal 305 (r(t)) may be received at the hearing location 323. The hearing location 320 may receive the first signal 305 as the received first left channel 335 and the received first right channel 340. In one embodiment, the hearing location 323 is similar to a human head, possibly on a human body, and the received first left channel 335 hl(t) is received in a microphone close to the left ear of a human head and the received first right channel 340 hr(t)is received in a microphone close to the right ear of the human head. The using of both a received first left channel 335 and a received first right channel 340 may improve the ability to create a spatial component to the received sound. It may be assumed that all speaking persons lie on a plane with the same elevation. Each configuration may be indexed by i in hli(t) and hri(t), 0<i<=I.

At block 210, the received first left channel 335 of the first signal 305 at the hearing location 323 may be stored in a memory as a first received left channel signal. The first signal 305 will be affected by a variety of factors before being received at the microphone 320 at the hearing location 323 and as the received first left channel 335 and the received first right channels 340, such as the room and the shape of the hearing location 323. Even the shape of the mock human head may affect the first signal 305 differently in each microphone placed near each mock ear. As a result, there will be difference between the communicated first signal 305 and the received first left channel 335 and received first right channel 340.

At block 215, the received first right channel 340 of the first signal 305 at the hearing location 323 may be stored in a memory as the received first right 340 signal. Again, the first signal 305 will be affected by a variety of factors before being received at the microphone 320 at the hearing location 323 and as the received first left channel 335 and the received first right channels 340, such as the room and the shape of the hearing location 323. Even the shape of the mock human head on the mock human body may affect the first signal 305 differently in each microphone placed near each mock ear. As a result, there will be difference between the communicated first signal 305 and the received first left channel 335 and the received first right channel 340.

When noise is negligible, it is rather straightforward to recover the combined head and room impulse responses (CHRIRs) using inverse filter. In the frequency domain, the result may be $$H_i^l(\omega) = \frac{S_i^l(\omega)}{R(\omega)} \text{ and } H_i^r(\omega) = \frac{S_i^r(\omega)}{R(\omega)}$$

where R(.) etc denote the discrete-time Fourier transforms of their time domain counterparts. The simple solution is obviously inadequate in reality as the effect of noise will be ever present. Instead of strictly following the steps of constructing an inverse filter, the method may follow a slightly different procedure. First, the method may obtain the time reversed signal r(−n) and convolve with the response signal r(n). Equivalently, what happens in the frequency domain is, using the left-ear case as the example, $$G_i^l(\omega)=S_i^l(\omega)R(\omega)=H_i^l(\omega)|R(\omega)|^2e^{-j\omega D}+U(\omega)R(-\omega)$$

where D is an arbitrary constant delay depending on the length chosen for r(n).

Note that so far the method may not be concerned about the amplification of the high frequency noise as the method may have in the case of direct inverse filtering.

However, $G_i^l(\omega)$ may not be a good estimate of $H_i^l(\omega)$ due to the magnitude distortion caused by $|R(\omega)|^2$. To that end, the method may apply a linear phase equalization filter derived from psychoacoustics means. Using the exact same set up, the method may play a known speech signal x(n) through the loudspeaker 310. Let the captured signal received by one of the microphones 320 (it doesn't matter which one) be y(n). The method may first define the initial equalization filter in the frequency domain to be $$E(\omega)=Y(\omega)/\hat{H}_i^l(\omega)X(\omega) \text{ and hence}$$

$$\hat{H}_i^l(\omega)=G_i^l(\omega)E(\omega)$$

Under the ideal condition free of any noise, the method may have completely removed the effect of $|R(\omega)|^2$ with the initial equalization filter. Such not being the case, the method may seek to find the filter E(ω) that minimizes the perceptual difference between the synthesized signal and captured signal:

$$E(\omega) = \underset{E'}{\operatorname{argmin}} \sum_k \left( \int_{\omega_k}^{\omega_{k+1}} \|M(\omega)(Y(\omega) - G_i^l(\omega)E'(\omega)X(\omega))\|^2 d\omega \right)^{1/3}$$

where M(ω) is a frequency domain masking curve determined via any standard procedure for input X(ω), and k is the index to the critical band partition of choice. In other words, the method may obtain E(ω) by minimizing a metric based on a simplified model of the human perceptual system. Alternatively, the method may also obtain a reasonable approximation of E(ω) via subjective listening evaluation of the synthesized and captured signal. To keep the minimization manageable, it suffices to assume E(ω) is smooth and is a constant within each critical band. It should be pointed out as well that in a real implementation the above equation should be considered in a frame by frame fashion and averaged over all available frames. Within each frame, sufficient care should be taken so that linear convolution can be roughly approximated.

It is known that room response estimation routines often modify the timbre of the room. The proposed perceptual formulation gives a means to match the timbre close to that of true binaural recording while keeping the noise amplification under control simultaneously. As a minor detail, note that the delay between $\hat{h}_i^l$ and $\hat{h}_i^r$ for the same i should be strictly maintained throughout the processing chain while the delays between $\hat{h}_i^l$ (or $\hat{h}_i^r$) for different I does not matter too much and can be calibrated.

At block 220, the first location 315 may be stored in a memory. The first location 315 may be a location in relation to the hearing location 323. As explained previously, in one embodiment, the location 315 may have a distance from the microphone 320 and a degree off from a centerline 325 (dashed) from the microphone 320. For example, the first location 315 may be 0 degrees off the center line 325 and the second location 330 may be approximately 30 degrees off the center line 325. In some embodiments, the location may be stored in a 360 degree format, such that the first location 315 may be stored as 0 degree and the second location 330 may be stored as 330 degrees (360−30). In addition, the location may include some data about the environment, such as the size of the room or the distance from the first source 315 to the surrounding walls, etc. Other data may include the surface of the walls, ambient noise in the room, whether there are windows in the location and if so, how many, the type of ceiling, the ceiling height, the floor covering, etc.

Figure 4:
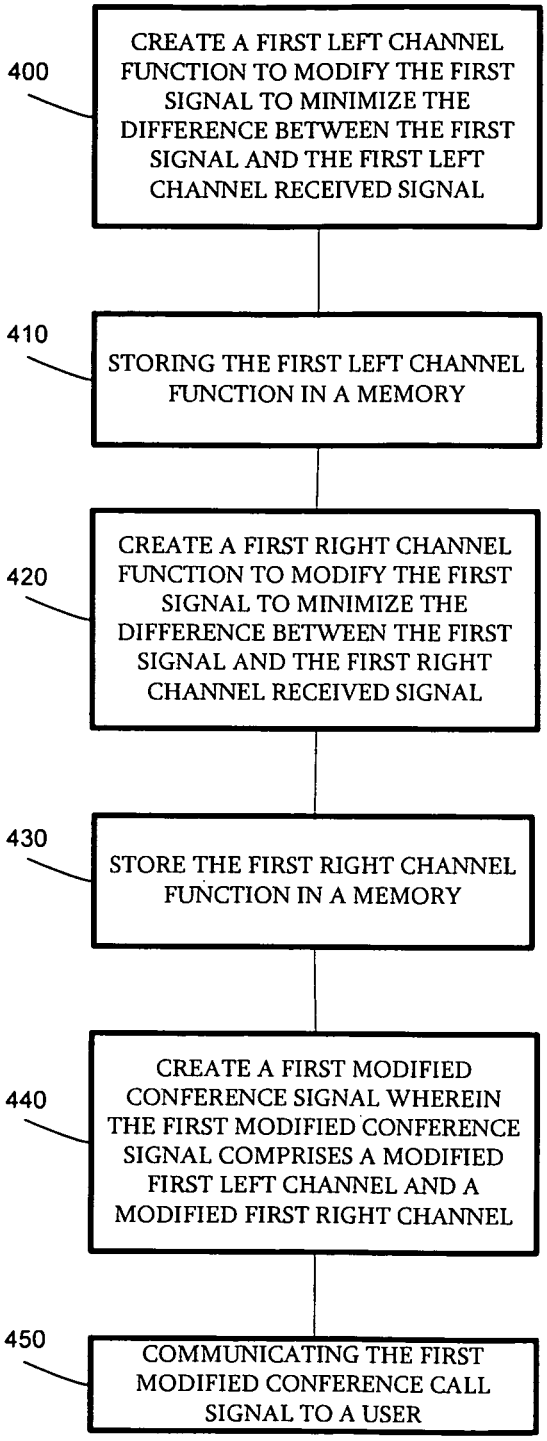
FIG. 4 may illustrate one embodiment of using the modeling and estimation of FIG. 2 to create a spatial audio signal.

FIG. 4 may illustrate one embodiment of using the modeling and estimation of FIG. 2 to create a spatial audio signal. Multiple audio streams from all other remote participants may be commonly multiplexed into one before sending to a particular participant. In order to enable spatialized audio, the method may need a different architecture that resembles a full-mesh peer-to-peer network. Regardless of how the network topology is implemented, some embodiments of the method may assume that each participant has access to any other remote participant' voice as an individual stream. Furthermore, the method may assume each conferencing location may have only one voice which is captured with a monophonic close-range microphone. When such assumptions can not be met, techniques such as source separation and dereverberation may be exploited so that a close enough approximation to our assumption can hold true.

When the number of participants is high in a meeting, it may not be practical to map each remote participant a distinctive location in which case strategies such as binning more than one remote participants to a shared virtual location can be considered. Without loss of generality, however, some embodiments may assume there is a one-to-one mapping between a remote participants and the rendering location. Under these assumptions, the task of the rendering spatial audio seems straightforward. For simplicity, suppose all CHRIRs, $\hat{h}_i^l(n)$ and $\hat{h}_i^r(n)$, have the same finite duration of N samples.

$$y_l(n) = \sum_i x_i(n) * \hat{h}_i^l(n)$$

$$y_r(n) = \sum_i x_i(n) * \hat{h}_i^r(n)$$

While on the surface this may appear similar to convolution reverberation, the described models entail a lot of more information than just reverberation and are estimated with unique means as discussed above. Nonetheless, the known difficulties with this approach still exist. Compared with the model-based approaches mentioned earlier, the CHRIRs are difficult to customize. Even with subjective tuning, the measured CHRIRs can not please every user. In particular, since human ears have varied tolerance to perceived reverberation, it may be beneficial to provide users with a means of adjusting to his own preference. Secondly, the method may be limited to render the speaker-listener configurations determined a prior at measurement time. It is rather difficult, for instance, to model a moving sound source. Thirdly, the computational cost is higher than the numerical model-based approach by any measure.

At block 400, a first left channel function may be created to modify the first signal 305 to minimize the difference between the first signal 305 and the first received left channel signal 335. In one embodiment, a Fourier transform is used to create the function to modify the first signal 305. Of course, other method to create the first left channel function to modify the first signal 305 to minimize the difference between the first signal 305 and the first received left channel signal 335 are possible and are contemplated.

The adjusting acoustic ratio may also be adjusted. The acoustic ratio may refer to the ratio between the energies of the sound waves following the direct path and the reverberation. A higher acoustic ratio implies a drier sounding signal and vice versa. The method may use the following means to locate the peak in any CHRIR that corresponds to the direct path, based on the intuitive principle that the direct path sound has the highest energy:

$$d_i^l = \underset{n}{\operatorname{argmin}} h_i^l(n)^2 \text{ and } d_i^r = \underset{n}{\operatorname{argmax}} h_i^r(n)^2$$

From here, using left ear channel as the example, the method may modify the CHRIR as $$\hat{h}_i^l(n) = \begin{cases} \alpha \hat{h}_i^l(t) & \text{where } t \in [d_i^l - \delta, d_i^l + \delta] \\ \hat{h}_i^l(t) & \text{elsewhere} \end{cases}$$

where $\delta$ defines a small neighborhood and $\alpha>0$ is a user controlled parameter which effectively changes the acoustic ratio of the synthesized audio.

In other applications of spatial audio such as games and movies, there are many occasions where the sound source undergoes significant motion while being rendered, in which case parametric 3D audio techniques that can explicitly model the motion trajectory are the most appropriate. In the pending method, there seems little need to model this type of source. Nonetheless, in the real world people do move slightly during talking and/or a listening person may sometimes want to move the virtual location of a remote participant. Following the method, it may be possible to include such small range motion in the synthesis system.

Upon inspection of a pair CHRIRs for the left and right ear channels from the same configuration, it may be seen that the most obvious contrast between them is the delay and level difference. Indeed, interaural time difference (ITD) and interaural intensity difference are the two prominent cues of directivity perception for the human hearing system. Though not sufficient to generate realistic spatial audio by themselves, experiences show that they suffice as tools to alter the perceived directivity from a pair of given CHRIRs. The ITD and IID of a pair of CHRIRs $\hat{h}_i^l(n)$ and $\hat{h}_i^r(n)$ are estimated as $$ITD_i = d_i^l - d_i^r \text{ and } IID_i = \sqrt{\frac{\sum_n \hat{h}_i^l(n)^2}{\sum_n \hat{h}_i^r(n)^2}}.$$

Next, these discrete IID and ITD samples are interpolated to generate the corresponding parameters at any arbitrary configuration $\phi$. Afterward, the method may construct the CHRIRs for any configuration $\phi$ as $$\hat{h}_\phi^l(t) = \sqrt{\frac{IID_\phi}{IID_i}}\, \hat{h}_i^l(t + ITD_\phi - ITD_i) \text{ and } \hat{h}_\phi^r(t) = \hat{h}_i^r(t)$$

During synthesis, the method may arbitrarily vary $\phi$, at a small range around each i to simulate a slow, localized moving source i.e. the speaking person. In addition to ITD and IID, note that can be altered as well to simulate a change of range. The same mechanism also provides a means for users to control the virtual location of a given source.

The direct convolution approach may have an algorithm complexity of O(IN) where I is the total number of participant and N is the length of CHRIR. The issue is that both I and N can be fairly large. To tackle the dimensionality of N, fast convolution methods taking advantage of the fast Fourier transform are readily available, although they invariably introduce a delay as the processing is in a block to block fashion. Since additional delay is undesirable for real-time conferencing applications, the method may follow some alternative ideas on improving the computational efficiency with no delay penalty.

First, a CHRIR may receive contributions from a number of known factors: direct path propagation, reflection and diffraction due to the human body parts, early reflection and late reverberation of the room, etc. Fortunately, all of the location dependent effects take place in early part of the CHRIR while anything afterwards (e.g. 10 milliseconds) is generally considered reverberation. Reverberation due to its very nature is mostly location independent. Given these observations, the method may decompose CHRIRs into the early portion, namely a short filter, and the late portion (a longer filter). Furthermore, the long filter is shared among all locations:

$$\hat{h}_{iS}^l(n) = \hat{h}_i^l(n),\ 0 \le n < M \text{ and}$$

$$\hat{h}_L(n) = \hat{h}_i^l(n),\ M \le n < N$$

for any arbitrarily chosen i, where M is a threshold set to for instance 10 milliseconds, again using the left ear channel as the example. Thus, to synthesize spatial audio for the ith location, the method may simply follow $$y_i^l(n) = x_i(n) * h_{iS}^l(n)$$

$$y^l(n) = \sum_i y_i^l(n) + h_L^l(n) * \sum_i x_i(n)$$

Figure 7:
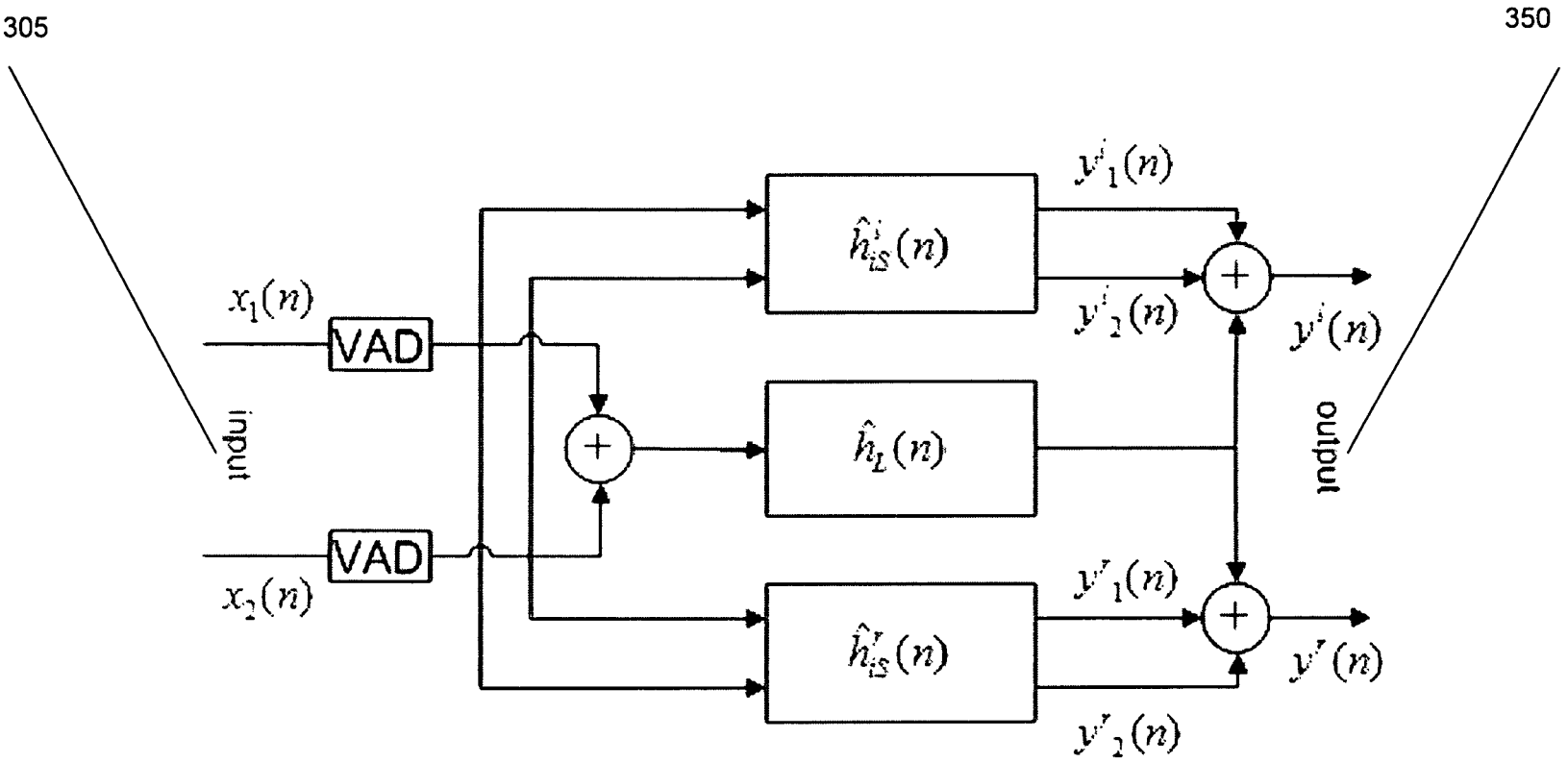
FIG. 7 is an illustration of one manner of converting an input signal into the output signal.

The right ear channel processing follows exactly the same routine. Note the new method has a complexity of O(IM+N). Since typically M<<N and N can be large, the saving is substantial. FIG. 7 may illustrate one possible illustration of the process in a graphical form where an input signal 305 is transformed into an output signal 350.

Secondly, the method may benefit from facts that voice activities come in segments and contain a lot of silences. In experience, the total span of voice activities in a multi-party conference is no longer than two times of the conference's duration. Thus each incoming remote participant's signal is monitored by a voice activity detector which typically has very low complexity. The spatial processing only takes place where actual speech activity is detected. Consequently, this further trims the algorithm complexity to 0 (2M+N). Note that synthesis now has bounded complexity independent of the total number of participants. The significance of this reduction is better appreciated in the context of real-world implementation where unbounded computational cost can not be tolerated. Once the first left channel function is created, at block 230, it may be stored in a memory.

At block 410, a first right channel function may be created to modify the first signal 305 to minimize the difference between the first signal 305 and the first right channel received signal 240. In one embodiment, a Fourier transform is used to create the function to modify the first signal 305. Of course, other method to create the first right channel function to modify the first signal 305 to minimize the difference between the first signal 305 and the first received right channel signal 340 are possible and are contemplated. Once the first right channel function is created, at block 240, it may be stored in a memory.

At block 420, a first modified conference signal may be created where the first modified conference signal comprises a modified first left channel and a modified first right channel by applying the first left channel function to a first conference call signal to create the modified first left channel and applying the first right channel function to the first conference call signal to create the modified first right channel.

At block 430, the first modified conference call signal my be communicated to a user. On some situations, the user may have headphones or a telephone with stereo speakers which may make the directional effect even more pronounced. The communication may occur using traditional POTS (plain old telephone service) or VoIP (voice over Internet Protocol) or any appropriate communication medium or scheme. In some embodiments, as a two channel (left right) signal may be communicated which may require some additional processing by the telephone systems.

In some embodiments, the will be more than one caller on a conference call. The second call may be treated in a similar way as the first. A possible difference is that the second source 330 will likely be at a different location 345 than the first source 310. More specifically, a second signal 350 from a second source 330 at a second location 345 wherein the second location 345 is different than the first location 315. The second signal 350 may be received at the hearing location 323 where the second signal 350 is received in a left channel 335 and a right channel 340 located at the hearing location 323. The received left channel 335 at the hearing location of the second signal 350 may be stored as a left received signal 335 of the second signal 350 in a memory. The right channel 340 of the second received signal 350 at the hearing location 323 maybe stored as a right received signal 340 of the second signal 350 in a memory. The second location 345 may be stored in a memory where the second location 345 may include a location in relation to the hearing location 323. A second left channel function may be created to modify the second signal 350 to minimize the difference between the second signal 350 and the left channel received signal 335 of the second signal 350. The second left channel function may be stored in a memory. Similarly, a second right channel function may be created to modify the second signal 350 to minimize the difference between the second signal 350 and the right channel received signal 340 of the second signal 350. The second right channel function may be stored in a memory.

A second modified conference call may be created where the second modified conference call may include a modified second left channel and a modified second right channel by applying the second left channel function to a second conference call signal 350 to create the modified second left channel and applying the second right channel function to the conference call signal 350 to create the modified second right channel. The first modified conference signal and the second modified conference signal may be combined to create a modified conference signal and the modified conference signal may be communicated to the user.

Combining the first modified conference signal and the second modified conference signal may occur in any logical sounding combining methodology. Logically, the modified first left channel and the modified second left channel may be combined into a combined modified left channel and the modified first right channel and the modified second right channel may be combined into a combined modified right channel.

In another embodiment, first location 315 of the first signal 305 may be varied to be different degrees off center from the hearing location 323 in order to create a variety of functions to reflect signals coming from a variety of angles. In application, the variety of location may be used to mimic people sitting around a table at a conference such as illustrated in FIG. 5, with each location 505-525 having a different function to modify the left 335 and right channels 340. In order to make the functions, the specific location 505-525 may be stored, an embodiment of the method such as the one described in FIG. 3 may be started, the resulting first left channel function may be stored in a memory available to be searched and the resulting first right channel function may be in a memory available to be searched.

The various functions may be used in a variety of ways. If there are two callers, one may be at 90 degrees off center and the second may be at −90 degrees (or 270 degrees) to enhance the spatial effect of the embodiments of the method. If there are four callers, one may be at −90 degrees (270 degrees), a second at −30 degrees (330 degrees), a third at 30 degrees and a fourth at 90 degrees from a center line to further enhance the spatial effects. As can be imagined, the more locations that are sampled and related functions that are created, the more options are available to increase the spatial effects and provide a more spatially enhanced telephone experience.

As with any conference call, there is no requirement that all the callers sit around a round table as is illustrated in FIG. 5. For example, caller 505 may be in Bangalore, India, caller 510 may be in Paris, France, caller 515 may be in London, England, caller 520 may be in New York and caller 525 may be in San Francisco, Calif. and the listener 323 may be in Chicago, Ill. However, in the listener's ear, the illusion may be created, by applying the various modification functions in a logical manner, that each caller 505-525 is sitting around a round table. Of course, the functions may be created to provide the illusion that the callers are sitting around a square table, a rectangular table, up in balconies, in a concert hall, in a stadium, etc. The variety of environments that can be analyzed and mimicked using the functions is virtually limitless.

In some embodiments, the method may interpolate between sampled locations 505-525 to determine left channel functions and right channel functions at locations between sampled locations 505-525. Various methods may be used to interpolated such as a weighting scheme or a least squares difference scheme. Of course, other schemes are possible and are contemplated.

Figure 6:
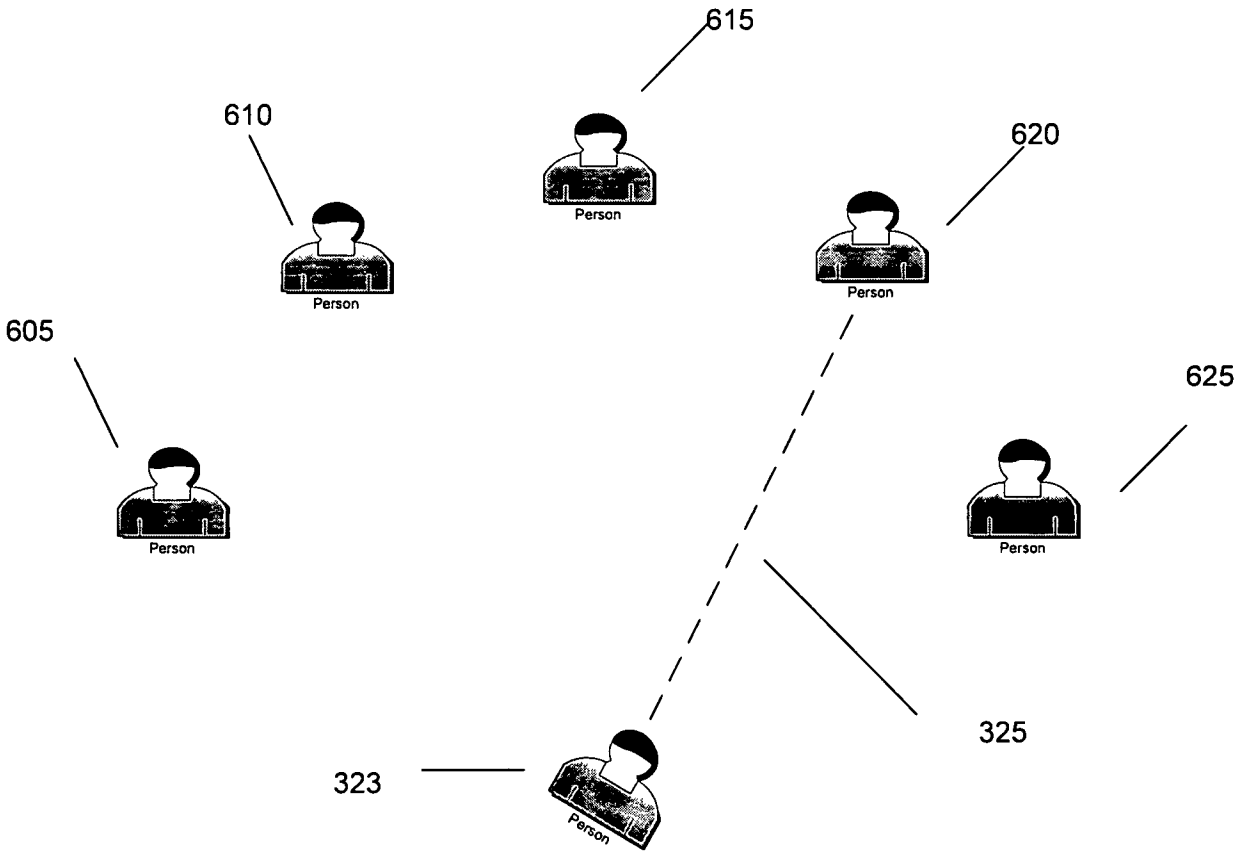
FIG. 6 is an illustration of a group of people sitting at various locations on a conference call where the listener has pivoted their head to move the centerline.

In some embodiments, the method may be able to tell if a user turns their head, such as to face the person that is talking. In one embodiment, the user wears headphones and the headphones have motion sensors. Referring to FIG. 5, the centerline 325 originally pointed toward source 515, with source 520 being 30 degrees off the centerline 325 and source 525 being 60 degrees off the centerline 325. In FIG. 6, the listener has turned toward source 520. The centerline 325 then adjusts to have source 520 at 0 degrees and source 525 is now at 30 degrees off the centerline 325 and source 515 is −30 degrees (330 degrees) off the centerline 325. Similar to real life, as the listener turns their head to face a speaker 505-525, the centerline may adjust and the relative locations of the sources 505-525 may also adjust accordingly. Once the relative position of the sources 505-525 is established in relation to the listener, an appropriate the right and left function may be selected that best match the degrees in relation to the new centerline 325.

In conclusion, the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The invention claimed is:

1. A computer storage device comprising computer executable instructions for providing directional hearing experience, the computer executable instructions comprising instructions for:

emitting sound generated by a first signal from a first source at a first location, the first signal comprising a reference signal;

receiving the sound generated from first signal at a hearing location, wherein the sound generated from the first signal is received in a left channel and a right channel located at the hearing location, the left channel received at a left microphone physically located at the hearing location at a position corresponding to a left ear of a head, the right channel received at a right microphone physically located at the hearing location at a position corresponding to a right ear of the head;

storing the left channel of the first signal received at the hearing location as a first left channel received signal;

storing the right channel of the first signal received at the hearing location as a first right channel received signal;

storing the first location, wherein the first location further comprises a location in relation to the hearing location; and computing a first right channel function that, based on the first signal and the first right channel, minimizes a difference between the first signal and the first right channel received signal;

computing a first left channel function that, based on the first signal and the first left channel, minimizes a difference between the first signal and the first left channel received signal;

receiving a first conference signal comprising a first left channel and a first right channel signal, wherein the first conference signal is not the first signal; and creating a modified first conference signal comprising a modified first right channel and a modified first left channel, the modified first right channel formed by applying the first left channel function to the first left signal and by applying the first right channel function to the first right signal.

2. The computer storage device of claim 1, the computer executable instructions further comprising instructions for:

creating a first left channel function to modify the first signal to minimize a difference between the first signal and the first left channel received signal;

storing the first left channel function;

creating a first right channel function to modify the first signal to minimize the difference between the first signal and the first right channel received signal;

storing the first right channel function;

creating a first modified conference call signal wherein the first modified conference call signal comprises a modified first left channel and a modified first right channel by applying the first left channel function to a first conference call signal to create the modified first left channel and applying the first right channel function to the first conference call signal to create the modified first right channel; and communicating the first modified conference call signal to a user wearing headphones.

3. The computer storage device of claim 2, the computer executable instructions further comprising instructions for:

broadcasting a second signal from a second source at a second location wherein the second location is different than the first location;

receiving the second signal at the hearing location wherein the second signal is received in the left channel and the right channel located at the hearing location;

storing the left channel of the second signal received at the hearing location as a second left received signal;

storing the right channel of the second signal received at the hearing location as a second right received signal;

storing the second location in a memory wherein the second location further comprises a location in relation to the hearing location;

creating a second left channel function to modify the second signal to minimize the difference between the second signal and the second left received signal;

storing the second left channel function;

creating a second right channel function to modify the second signal to minimize the difference between the second signal and the second right received signal;

storing the second right channel function;

creating a second modified conference call wherein the second modified conference call comprises a modified second left channel and a modified second right channel by applying the second left channel function to a second conference call signal to create the modified second left channel and applying the second right channel function to the conference call to create the modified second right channel;

combining the first modified conference call signal and the second modified conference call to create a modified conference signal; and communicating the modified conference signal to a user wearing headphones.

4. The computer storage device of claim 2, wherein the first location comprises a first degrees wherein the first degrees comprises degrees off a center from a listening device or the user to the first location; and a first distance wherein the first distance is a distance from the listening device to the first location and wherein the second location comprises:

a second degrees wherein the second degrees comprises the degrees off the center from the listening device to the second location; and a second distance wherein the second distance is a distance from the listening device to the second location.

5. The computer storage device of claim 4, further comprising computer executable code for:

determining if the user has made a head turn comprising turning a user's head off the center;

adjusting the first signal to compensate for the head turn, further comprising:

adjusting the center to be a new center wherein the new center is perpendicular to a view of the user; and selecting the first right channel function and the first left channel function that best matches the degrees in relation to the new center.

6. The computer storage device of claim 2, further comprising computer executable instructions for interpolating between locations to determine the first left channel function and the first right channel function or the second left channel function and the second right channel function.

7. The computer storage device of claim 2, the computer executable instructions further comprising instructions for:

combining the first modified conference call signal and the second modified conference call signal to create a modified conference signal; and communicating the modified conference signal.

8. The computer storage device claim 7, wherein combining the first modified conference call signal and the second modified conference call signal comprises:

combining the modified first left channel and the modified second left channel into a combined modified left channel; and combining the modified first right channel and the modified second right channel into a combined modified right channel.

9. The computer storage device of claim 2, further comprising varying the location of the generation of audio from the first signal to be different degrees off center from the hearing location;

storing the varied location;

storing the first left channel function that results to be available to be searched; and storing the first right channel function that results to be available to be searched.

10. The computer storage device of claim 1, wherein the first location comprises:

a first degrees wherein the first degrees comprises degrees off a center from a listening device or the user to the first location; and a first distance wherein the first distance is a distance from the listening device to the first location.

11. A computer system comprising a processor physically configured according to computer executable instructions for providing directional hearing experience for a conference call, a memory for maintaining the computer executable instructions and an input/output circuit, the computer executable instructions comprising computer executable instructions for:

creating a first left channel function to using a first signal and a first left channel received signal to minimize a difference between the first signal and the first left channel received signal, the left channel received signal comprising a signal from a left microphone receiving audio emitted from a speaker, the audio having been generated from the first signal, the first signal comprising a reference signal;

storing the first left channel function;

creating a first right channel function using the first signal and a first right channel received signal to minimize a difference between the first signal and the first right channel received signal, the first right channel received signal comprising a signal from a right microphone receiving the audio emitted from the speaker;

storing the first right channel function;

receiving a first conference call signal corresponding to sound received by the left microphone and by the right microphone, wherein the conference call signal is not the reference signal;

creating a first modified conference call signal, wherein the first modified conference call signal comprises a modified first left channel and a modified first right channel, the modified first left channel created by applying the first left channel function to the first conference call signal to create the modified first left channel, and the modified first right channel created by applying the first right channel function to the first conference call signal to create the modified first right channel; and generating sound from the first modified conference call signal.

12. The computer system of claim 11, the computer executable instructions further comprising instructions for:

emitting the audio from the speaker at a first location;

receiving the emitted audio at a hearing location wherein the emitted audio is received in a left channel comprising the left speaker and a right channel comprising the right speaker;

storing the left channel as a first left channel received signal and storing the right channel as a first right channel received signal;

storing the first location wherein the first location further comprises a location in relation to the hearing location.

13. The computer system of claim 12, the computer executable instructions further comprising instructions for:

emitting audio of a second signal from a second source at a second location wherein the second location is different than the first location;

receiving the emitted audio of the second signal at the hearing location wherein the audio of the second signal is received in the left channel and the right channel located at the hearing location;

storing the left channel of the second signal received at the hearing location as a second left received signal;

storing the right channel of the second signal received at the hearing location as a second right received signal;

storing the second location, wherein the second location is in relation to the hearing location;

creating a second left channel function to modify the second signal to minimize a difference between the second signal and the second left received signal;

storing the second left channel function;

creating a second right channel function to modify the second signal to minimize a difference between the second signal and the second right received signal;

storing the second right channel function;

creating a second modified conference call signal wherein the second modified conference call signal comprises a modified second left channel and a modified second right channel by applying the second left channel function to a second conference call signal to create the modified second left channel and applying the second right channel function to the conference call to create the modified second right channel;

combining the first modified conference call signal and the second modified conference call signal to create a modified conference signal; and communicating the modified conference signal to a user wearing headphones.

14. The computer system of claim 12, wherein the first location comprises a first degrees wherein the first degrees comprises degrees off a center from a listening device or the user to the first location; and a first distance wherein the first distance is a distance from the listening device to the first location and wherein the second location comprises a second degrees wherein the second degrees comprises the degrees off the center from the listening device to the second location; and a second distance wherein the second distance is a distance from the listening device to the second location.

15. A method performed by one or more computers for providing directional sound for a conference call, the method comprising:

emitting sound from a first source, the sound generated from a first signal and emitted while the first source is at a first location, the first signal comprising a reference signal;

receiving the sound at a hearing location wherein the first signal is received in a left channel comprising a left microphone and a right channel comprising a right microphone, the left and right microphone located at the hearing location;

storing the left channel of the first signal received at the hearing location as a first left channel received signal;

storing the right channel of the first signal received at the hearing location as a first right channel received signal;

computing a right function using the reference signal and the first right channel received signal, and computing a left function using the reference signal and the first left channel received, each function minimizing a respective difference between the corresponding channel received signal and the reference signal, the differences respectively corresponding to combined head-room impulse responses;

receiving a conference signal that is not the reference signal and applying the functions to respective right and left components of the conference signal to form a modified conference signal.

* * * * *